US012303020B2

(12) United States Patent
Odesho

(10) Patent No.: US 12,303,020 B2
(45) Date of Patent: May 20, 2025

(54) HAIR BRUSH

(71) Applicant: Bounce Curl, LLC, Phoenix, AZ (US)

(72) Inventor: Merian M. Odesho, Phoenix, AZ (US)

(73) Assignee: Bounce Curl, LLC, Phoenix, AZ (US)

( * ) Notice: Subject to any disclaimer, the term of this patent is extended or adjusted under 35 U.S.C. 154(b) by 0 days.

(21) Appl. No.: 18/784,912

(22) Filed: Jul. 25, 2024

(65) Prior Publication Data

US 2025/0031836 A1 Jan. 30, 2025

Related U.S. Application Data

(63) Continuation-in-part of application No. 29/933,246, filed on Mar. 19, 2024, and a continuation of application No. PCT/US2024/013397, filed on Jan. 29, 2024, said application No. 29/933,246 is a continuation of application No. 29/880,941, filed on Jul. 28, 2023, now Pat. No. Des. 1,028,527, said application No. PCT/US2024/013397 is a continuation-in-part of application No. 29/880,941, filed on Jul. 28, 2023, now Pat. No. Des. 1,028,527.

(51) Int. Cl.

| | |
|---|---|
| ***A46B 9/02*** | (2006.01) |
| ***A46B 15/00*** | (2006.01) |
| *A46B 5/00* | (2006.01) |

(52) U.S. Cl.

CPC ..... *A46B 9/023* (2013.01); *A46B 15/0059* (2013.01); *A46B 5/00* (2013.01); *A46B 2200/104* (2013.01)

(58) Field of Classification Search

CPC ..... A46B 2200/104; A46B 15/0051; A46B 15/0059; A46B 9/023

USPC ..... 132/120, 158; D4/117

See application file for complete search history.

(56) References Cited

U.S. PATENT DOCUMENTS

| | | | | |
|---|---|---|---|---|
| 1,398,864 | A | 11/1921 | Kelly | |
| D60,615 | S | 3/1922 | Halinka et al. | |
| 1,654,117 | A * | 12/1927 | Durlacher | A46B 15/00 132/158 |
| D101,982 | S | 11/1936 | Dean | |
| D105,165 | S | 6/1937 | Dean | |
| D115,687 | S | 7/1939 | Davis | |
| 2,633,591 | A | 4/1953 | Servilla | |
| D192,785 | S | 5/1962 | Vallis | |
| 3,253,292 | A | 5/1966 | Herschensohn | |
| D249,909 | S | 10/1978 | Epstein | |

(Continued)

FOREIGN PATENT DOCUMENTS

| | | | |
|---|---|---|---|
| CA | 209068 S | 3/2023 | |
| CH | 181654 A * | 12/1935 | A46B 15/0059 |

(Continued)

OTHER PUBLICATIONS

English translation of CH 181654 A, Leuthold, Dec. 31, 1935. (Year: 1935).*

(Continued)

*Primary Examiner* — Laura C Guidotti

(74) *Attorney, Agent, or Firm* — UB Greensfelder LLP; Matthew J. Schonauer

(57) ABSTRACT

A brush comprising a brush head having a brush pad with a plurality of bristles and a plurality of channels disposed along at least one side of the brush head, wherein each of the plurality of channels has a predetermined depth.

3 Claims, 8 Drawing Sheets

(56) References Cited

U.S. PATENT DOCUMENTS

| | | | | |
|---|---|---|---|---|
| D326,562 | S | 6/1992 | Bertwell | |
| D370,304 | S | 5/1996 | Schach | |
| 6,341,611 | B1 | 1/2002 | Nakamura | |
| D498,059 | S | 11/2004 | Cheung | |
| D504,234 | S | 4/2005 | Kuo | |
| D513,883 | S | 1/2006 | Kampel | |
| D518,297 | S | 4/2006 | Little | |
| 7,243,428 | B2 | 7/2007 | Okaniwa | |
| 8,656,933 | B2 * | 2/2014 | Boyd | A46B 15/0002 132/120 |
| D728,944 | S | 5/2015 | Noel | |
| D750,896 | S | 3/2016 | Park | |
| D758,740 | S | 6/2016 | Brown | |
| D764,808 | S | 8/2016 | Rosenzweig | |
| 9,402,460 | B2 * | 8/2016 | Hickey | A46B 9/023 |
| D781,596 | S | 3/2017 | Chang | |
| D781,597 | S | 3/2017 | Treeby | |
| D783,292 | S | 4/2017 | Chang | |
| D809,305 | S | 2/2018 | Brown | |
| D825,929 | S | 8/2018 | Julemont | |
| D826,572 | S | 8/2018 | Hanson | |
| D834,332 | S | 11/2018 | Chen | |
| D846,888 | S | 4/2019 | Rosenzweig | |
| D854,340 | S | 7/2019 | Kuo | |
| D892,415 | S | 8/2020 | Axelrod | |
| D893,888 | S | 8/2020 | Sze | |
| D903,333 | S | 12/2020 | Choi | |
| D905,970 | S | 12/2020 | Rennette | |
| D930,367 | S | 9/2021 | Wojczak | |
| D935,197 | S | 11/2021 | Rennette | |
| D936,372 | S | 11/2021 | Hulin | |
| D939,221 | S | 12/2021 | Park | |
| D941,036 | S | 1/2022 | Hinds | |
| D941,037 | S | 1/2022 | Wojczak | |
| D941,592 | S | 1/2022 | Russo | |
| D946,905 | S | 3/2022 | Hinds | |
| D948,875 | S | 4/2022 | Brosmith | |
| D979,253 | S | 2/2023 | Janowick | |
| D985,281 | S | 5/2023 | Russo | |
| D1,020,267 | S | 4/2024 | Li | |
| D1,025,614 | S | 5/2024 | Odesho | |
| D1,028,527 | S | 5/2024 | Odesho | |
| D1,028,532 | S | 5/2024 | Russo | |
| D1,039,844 | S | 8/2024 | Ndiaye | |
| D1,041,176 | S | 9/2024 | Wei | |
| D1,045,405 | S | 10/2024 | Yang | |
| D1,049,648 | S | 11/2024 | Wang | |
| D1,049,649 | S | 11/2024 | Zhou | |
| D1,049,651 | S | 11/2024 | Zhou | |
| D1,051,611 | S | 11/2024 | Wang | |
| 12,150,542 | B1 | 11/2024 | Campbell | |
| 2008/0283075 | A1 * | 11/2008 | Vance | A45D 24/04 132/200 |
| 2011/0239390 | A1 | 10/2011 | Park | |
| 2015/0342334 | A1 | 12/2015 | Hickey | |
| 2024/0156245 | A1 | 5/2024 | Pulfrey | |
| 2024/0164514 | A1 | 5/2024 | Kim | |

FOREIGN PATENT DOCUMENTS

| | | | |
|---|---|---|---|
| CN | 118159171 | A | 6/2024 |
| CN | 308773082 | S | 8/2024 |
| EM | 0150824430008 | S | 11/2024 |
| EM | 0150837370001 | S | 12/2024 |
| EP | 4387488 | A1 | 6/2024 |
| GB | 6392239 | S | 10/2024 |
| GB | 6393909 | S | 10/2024 |
| JP | 2024035543 | A | 3/2024 |
| KR | 1020240076303 | A | 5/2024 |
| KR | 1020240097488 | A | 6/2024 |
| KR | 102699767 | B1 | 8/2024 |
| WO | 2006135116 | A1 | 12/2006 |
| WO | 2013178977 | A1 | 12/2013 |
| WO | 217763 | S | 5/2022 |
| WO | 2023021255 | A1 | 2/2023 |

OTHER PUBLICATIONS

"The A-Z of Curly Hair Brushes: What Are the Best Brushes For Curly Hair?" by Curl Talk, Dec. 4, 2022, https://livloves.co.uk/2022/12/04/the-a-z-of-curly-hair-brushes-what-is-the-best-brush-for-styling-curly-hair/ . (Year: 2022).*

Instagram-Bouncecurl; "Define Brush is Here!. . . "; [online] 'https://www.instagram.com/p/CvPZbV1sCPe'; Dated Jul. 28, 2023; Accessed Mar. 19, 2024; 2pgs. (Year: 2023) Jul. 28, 2023.

Bounce Curl, announced Dec. 2023 [online], [site visited Jan. 15, 2025]. Avail from int, URL: https://www.amazon.com/Bounce-Curl-EdgeLift-Effortlessly-Defined/dp/B0DF88V52N/ref=sr_1_86 (Year: 2023) Dec. 2023.

Che Beauty Avail from int, URL: https://chebeauty.com/products/curly-hair-styling-brush 2024.

FOTN, announced Nov. 2024 [online], [site visited Jan. 15, 2025]. Avail from int, URL: https://www.amazon. com/ Defining-Combing-Shaping-Flexible-Enhancing/dp/B0DJZ7DMJG/ref=sr_1_39 (Year: 2024) Nov. 2024.

Idaoli, announced Dec. 2024 [online], [site visited Jan. 15, 2025]. Avail from int, URL: https://www.amazon.com/ iDAOLI-Bristle-Styling-Shaping-Defining/dp/B0D3PQV8FL/ref=sr_1_9 (Year: 2024) Dec. 2024.

Jefuzh, announced Dec. 2024 [online], [site visited Jan. 15, 2025]. Avail from int, URL: https://www.amazon.com/ Defining-Combing-Shaping-Pulling-Separation/dp/B0DP4X4TX8/ref=sr_1_7 (Year: 2024) Dec. 2024.

Purple Mango, announced Sep. 2024 [online], [site visited Jan. 15, 2025]. Avail from int, URL: https://www.amazon.com/dp/BOD84F2RB8/ ref=sspa_dk_detail_6 (Year: 2024) Sep. 2024.

* cited by examiner

HAIR BRUSH

CROSS-REFERENCE TO RELATED APPLICATIONS

This patent application is a continuation of PCT Application No. PCT/US2024/013397 filed 29 Jan. 2024, which is a continuation-in-part of U.S. Design patent application Ser. No. 29/880,941 filed on 28 Jul. 2023, and is also a continuation-in-part of U.S. Design patent application Ser. No. 29/933,246 filed 19 Mar. 2024, which is a continuation of U.S. Design patent application Ser. No. 29/880,941 filed 28 Jul. 2023, the disclosures each of which are hereby incorporated by reference herein in their entirety.

TECHNICAL FIELD

Exemplary embodiments of the present disclosure relate generally to hair brushes, especially hair brushes for curly hair.

BACKGROUND OF THE INVENTION

The following background is provided simply as an aid in understanding the present disclosure rather than to describe or constitute prior art to the present disclosure.

Conventional hair styling devices and brushes typically allow for the smoothing of hair through bristles or other similar protrusions. However, because conventional styling devices and brushes are often hair style-specific, multiple devices are needed to achieve the final styling result. Even if such devices allow for the creation of multiple hair styles, they are often complex to use and time consuming.

Further, existing devices and brushes directed specifically to curly hair often increase frizz and reduce hair volume and definition, while also including the same limitations as described above. Therefore, there is a need for an easy-to-use, eco-friendly hair brush that enhances waves, curls, and coils in hair, while eliminating frizz and promoting hair smoothness. No known references, taken alone or in combination, are seen as teaching or suggesting the presently claimed hair brush.

BRIEF SUMMARY OF THE INVENTION

The following provides a summary of certain example implementations of the disclosed technology. This summary is not an extensive overview and is not intended to identify key or critical aspects or elements of the disclosed technology or to delineate its scope. However, it is to be understood that the use of indefinite articles in the language used to describe and claim the disclosed technology is not intended in any way to limit the described technology. Rather the use of "a" or "an" should be interpreted to mean "at least one" or "one or more".

One implementation of the disclosed technology provides a brush. The brush comprises a brush head having a brush pad with a plurality of bristles; and a plurality of channels disposed along at least one side of the brush head, wherein each of the plurality of channels has a predetermined depth that extends from a top surface of the brush head through a bottom surface of the brush head.

The brush may further comprise a handle member connected to the brush head, wherein the handle member includes a tapered end. The plurality of channels may be substantially U-shaped. Each of the plurality of channels may have a length of about 10.03 mm, and wherein each of the plurality of channels may be separated by a distance of about 5.14 mm; each of the plurality of channels may have a length of about 10.33 mm, and wherein each of the plurality of channels may be separated by a distance of about 5.09 mm; or each of the plurality of channels may have a length of about 5.01 mm, and wherein each of the plurality of channels may be separated by a distance of about 2.51 mm. The brush may further comprise a second plurality of channels disposed along a second side of the brush head. Each of the second plurality of channels may have a length of about 10.03 mm, and wherein each of the second plurality of channels may be separated by a distance of about 5.14 mm; each of the second plurality of channels may have a length of about 10.33 mm, and wherein each of the second plurality of channels may be separated by a distance of about 5.09 mm; or each of the second plurality of channels may have a length of about 5.01 mm, and wherein each of the second plurality of channels may be separated by a distance of about 2.51 mm. The brush may further comprise a third plurality of channels disposed along a third side of the brush head. Each of the third plurality of channels may have a length of about 10.03 mm, and wherein each of the third plurality of channels may be separated by a distance of about 5.14 mm; each of the third plurality of channels may have a length of about 10.33 mm, and wherein each of the third plurality of channels may be separated by a distance of about 5.09 mm; or each of the third plurality of channels may have a length of about 5.01 mm, and wherein each of the third plurality of channels may be separated by a distance of about 2.51 mm. The brush pad may comprise a plurality of holes formed in a face and an edge of the brush pad, wherein the plurality of bristles extend outwardly from the plurality of holes at predetermined heights and predetermined angles.

The brush may further comprise a handle member connected to the brush head, wherein the handle member includes a tapered end. The plurality of channels may be substantially U-shaped. Each of the plurality of channels may have a length of 9.5-10.5 mm, or 10, mm; and wherein each of the channels may be separated by a distance of 4.5-5.5 mm, or 5 mm; each of the channels may have a length of 9.5-10.5 mm, or 10 mm, and wherein each of the plurality of channels may be separated by a distance of 4.5-5.5 mm, or 5 mm; or each of the plurality of channels may have a length of 4.5-5.5 mm, or 5 mm, and wherein each of the plurality of channels may be separated by a distance of 2.0-3.0 mm, or 2.5 mm. The brush may further comprise a second plurality of channels disposed along a second side of the brush head. Each of the second plurality of channels may have a length of 9.5-10.5 mm, or 10 mm, and wherein each of the second plurality of channels may be separated by a distance of about 5 mm; each of the second plurality of channels may have a length of 9.5-10.5 mm, or 10 mm, and wherein each of the second plurality of channels may be separated by a distance of about 5 mm; or each of the second plurality of channels may have a length of 4.5-5.5 mm, or 5 mm, and wherein each of the second plurality of channels may be separated by a distance of 2.0 to 3.0 mm, or 2.5 mm. The brush may further comprise a third plurality of channels disposed along a third side of the brush head. Each of the third plurality of channels may have a length of 9.5-10.5 mm, or 10 mm, and wherein each of the third plurality of channels may be separated by a distance of 4.5-5.5 mm, or 5 mm; each of the third plurality of channels may have a length of 9.5-10.5 mm, or 10 mm, and wherein each of the third plurality of channels may be separated by a distance of 4.5-5.5 mm, or 5 mm; or each of the third plurality of channels may have a length of 4.5-5.5 mm, or 5 mm, and wherein each of the third plurality of channels may be separated by a distance of 2.0 to 3.0 mm, or 2.5 mm. The brush pad may comprise a plurality of holes formed in a face and an edge of the brush pad, wherein the plurality of bristles extend outwardly from the plurality of holes at predetermined heights and predetermined angles. Another implementation of the disclosed technology provides a hair brush. The hair brush comprises a brush head having a brush pad with a plurality of bristles that extend at a predetermined height above the brush head; a plurality of channels disposed along at least one side of the brush head, wherein each of the plurality of channels has a predetermined depth; and a handle member having a tapered end.

The plurality of channels may be substantially U-shaped. Each of the plurality of channels may have a length of about 10.03 mm, and wherein each of the plurality of channels may be separated by a distance of about 5.14 mm; each of the plurality of channels may have a length of about 10.33 mm, and wherein each of the plurality of channels may be separated by a distance of about 5.09 mm; or each of the plurality of channels may have a length of about 5.01 mm, and wherein each of the plurality of channels may be separated by a distance of about 2.51 mm. The brush may further comprise a second plurality of channels disposed along a second side of the brush head. Each of the second plurality of channels may have a length of about 10.03 mm, and wherein each of the second plurality of channels may be separated by a distance of about 5.14 mm; each of the second plurality of channels may have a length of about 10.33 mm, and wherein each of the second plurality of channels may be separated by a distance of about 5.09 mm; or each of the second plurality of channels may have a length of about 5.01 mm, and wherein each of the second plurality of channels may be separated by a distance of about 2.51 mm. The brush may further comprise a third plurality of channels disposed along a third side of the brush head. Each of the third plurality of channels may have a length of about 10.03 mm, and wherein each of the third plurality of channels may be separated by a distance of about 5.14 mm; each of the third plurality of channels may have a length of about 10.33 mm, and wherein each of the third plurality of channels may be separated by a distance of about 5.09 mm; or each of the third plurality of channels may have a length of about 5.01 mm, and wherein each of the third plurality of channels may be separated by a distance of about 2.51 mm. The brush pad may comprise a plurality of holes formed in a face and an edge of the brush pad, wherein the plurality of bristles extend outwardly from the plurality of holes at predetermined angles.

The plurality of channels may be substantially U-shaped. Each of the plurality of channels may have a length of 9.5-10.5 mm, or 10 mm, and wherein each of the plurality of channels may be separated by a distance of 4.5-5.5 mm, or 5 mm; each of the plurality of channels may have a length of 9.5-10.5 mm, or 10 mm, and wherein each of the plurality of channels may be separated by a distance of 4.5-5.5 mm, or 5 mm; or each of the plurality of channels may have a length of 4.5-5.5 mm, or 5 mm, and wherein each of the plurality of channels may be separated by a distance of 2.0 to 3.0 mm, or 2.5 mm. The brush may further comprise a second plurality of channels disposed along a second side of the brush head. Each of the second plurality of channels may have a length of 9.5-10.5 mm, or 10 mm, and wherein each of the second plurality of channels may be separated by a distance of 4.5-5.5 mm, or 5 mm; each of the second plurality of channels may have a length of 9.5-10.5 mm, or 10 mm, and wherein each of the second plurality of channels may be separated by a distance of 4.5-5.5 mm, or 5 mm; or each of the second plurality of channels may have a length of 4.5-5.5 mm, or 5 mm, and wherein each of the second plurality of channels may be separated by a distance of 2.0 to 3.0 mm, or 2.5 mm. The brush may further comprise a third plurality of channels disposed along a third side of the brush head. Each of the third plurality of channels may have a length of 9.5-10.5 mm, or 10 mm, and wherein each of the third plurality of channels may be separated by a distance of 4.5-5.5 mm, or 5 mm; each of the third plurality of channels may have a length of 9.5-10.5 mm, or 10 mm, and wherein each of the third plurality of channels may be separated by a distance of 4.5-5.5 mm, or 5 mm; or each of the third plurality of channels may have a length of 4.5-5.5 mm, or 5 mm, and wherein each of the third plurality of channels may be separated by a distance of 2.0 to 3.0 mm, or 2.5 mm. The brush pad may comprise a plurality of holes formed in a face and an edge of the brush pad, wherein the plurality of bristles extend outwardly from the plurality of holes at predetermined angles.

Still another implementation of the disclosed technology provides a brush. The brush comprises a first plurality of channels disposed along a first side of a brush head; a second plurality of channels disposed along a second side of a brush head; a third plurality of channels disposed along a third side of a brush head; and a brush pad having a plurality of bristles, wherein each of the first, second, and third plurality of channels has a predetermined depth that extends from a top surface of the brush head to a bottom surface of the brush head.

Each of the first plurality of channels: may have a length of about 10.03 mm, and wherein each of the first plurality of channels may be separated by a distance of about 5.14 mm; a length of about 10.33 mm, and wherein each of the first plurality of channels may be separated by a distance of about 5.09 mm; or a length of about 5.01 mm, and wherein each of the first plurality of channels may be separated by a distance of about 2.51 mm. Each of the second plurality of channels may have a length of about 10.03 mm, and wherein each of the second plurality of channels may be separated by a distance of about 5.14 mm; a length of about 10.33 mm, and wherein each of the second plurality of channels may be separated by a distance of about 5.09 mm; or a length of about 5.01 mm, and wherein each of the second plurality of channels may be separated by a distance of about 2.51 mm. Each of the third plurality of channels may have a length of about 10.03 mm, and wherein each of the third plurality of channels may be separated by a distance of about 5.14 mm; a length of about 10.33 mm, and wherein each of the third plurality of channels is separated by a distance of about 5.09 mm; or a length of about 5.01 mm, and wherein each of the third plurality of channels is separated by a distance of about 2.51 mm. The first, second, and third plurality of channels may be substantially U-shaped.

Each of the first plurality of channels: may have a length of 9.5-10.5 mm, or 10 mm, and wherein each of the first plurality of channels may be separated by a distance of 4.5-5.5 mm, or 5 mm; a length of 9.5-10.5 mm, or 10 mm, and wherein each of the first plurality of channels may be separated by a distance of 4.5-5.5 mm, or 5 mm; or a length of 4.5-5.5 mm, or 5 mm, and wherein each of the first plurality of channels may be separated by a distance of 2.0 to 3.0 mm, or 2.5 mm. Each of the second plurality of channels may have a length of 9.5-10.5 mm, or 10 mm, and wherein each of the second plurality of channels may be separated by a distance of 4.5-5.5 mm, or 5 mm; a length of 9.5-10.5 mm, or 10 mm, and wherein each of the second plurality of channels may be separated by a distance of 4.5-5.5 mm, or 5 mm; or a length of 4.5-5.5 mm, or 5 mm, and wherein each of the second plurality of channels may be separated by a distance of 2.0 to 3.0 mm, or 2.5 mm. Each of the third plurality of channels may have a length of 9.5-10.5 mm, or 10 mm, and wherein each of the third plurality of channels may be separated by a distance of 4.5-5.5 mm, or 5 mm; a length of 9.5-10.5 mm, or 10 mm, and wherein each of the third plurality of channels is separated by a distance of 4.5-5.5 mm, or 5 mm; or a length of 4.5-5.5 mm, or 5 mm, and wherein each of the third plurality of channels is separated by a distance of 2.0 to 3.0 mm, or 2.5 mm. The first, second, and third plurality of channels may be substantially U-shaped.

It should be appreciated that all combinations of the foregoing concepts and additional concepts discussed in greater detail below (provided such concepts are not mutually inconsistent) are contemplated as being part of the technology disclosed herein and may be implemented to achieve the benefits as described herein. Additional features and aspects of the disclosed system, devices, and methods will become apparent to those of ordinary skill in the art upon reading and understanding the following detailed description of the example implementations. As will be appreciated by the skilled artisan, further implementations are possible without departing from the scope and spirit of what is disclosed herein. Accordingly, the descriptions provided herein are to be regarded as illustrative and not restrictive in nature.

BRIEF DESCRIPTION OF THE DRAWINGS

The accompanying drawings, which are incorporated into and form a part of the specification, schematically illustrate one or more example implementations of the disclosed technology and, together with the general description given above and detailed description given below, serve to explain the principles of the disclosed subject matter, and wherein.

DETAILED DESCRIPTION

Figure 1:
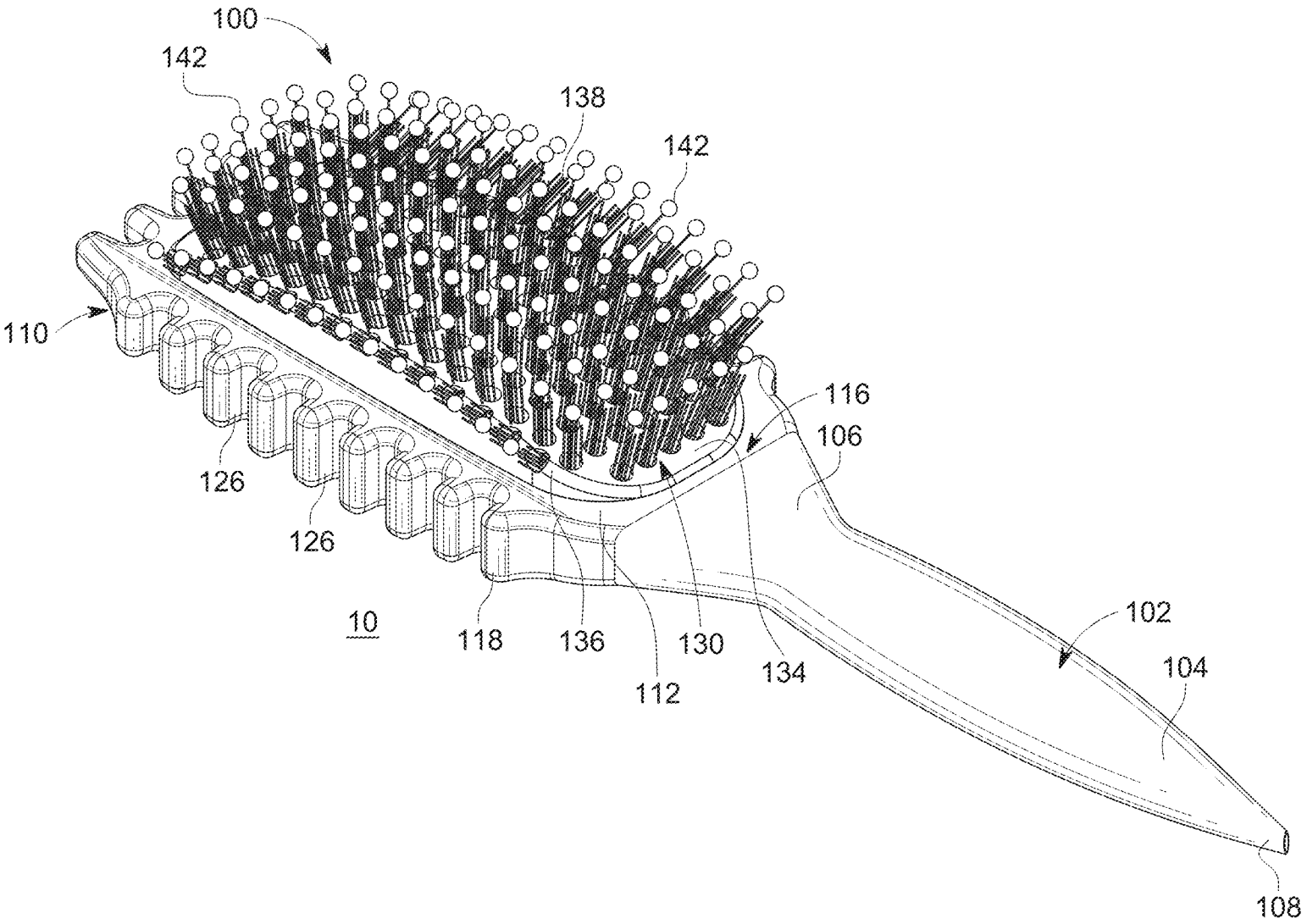
FIG. 1 is a perspective view of an example implementation of the disclosed hair brush.
Figure 2:
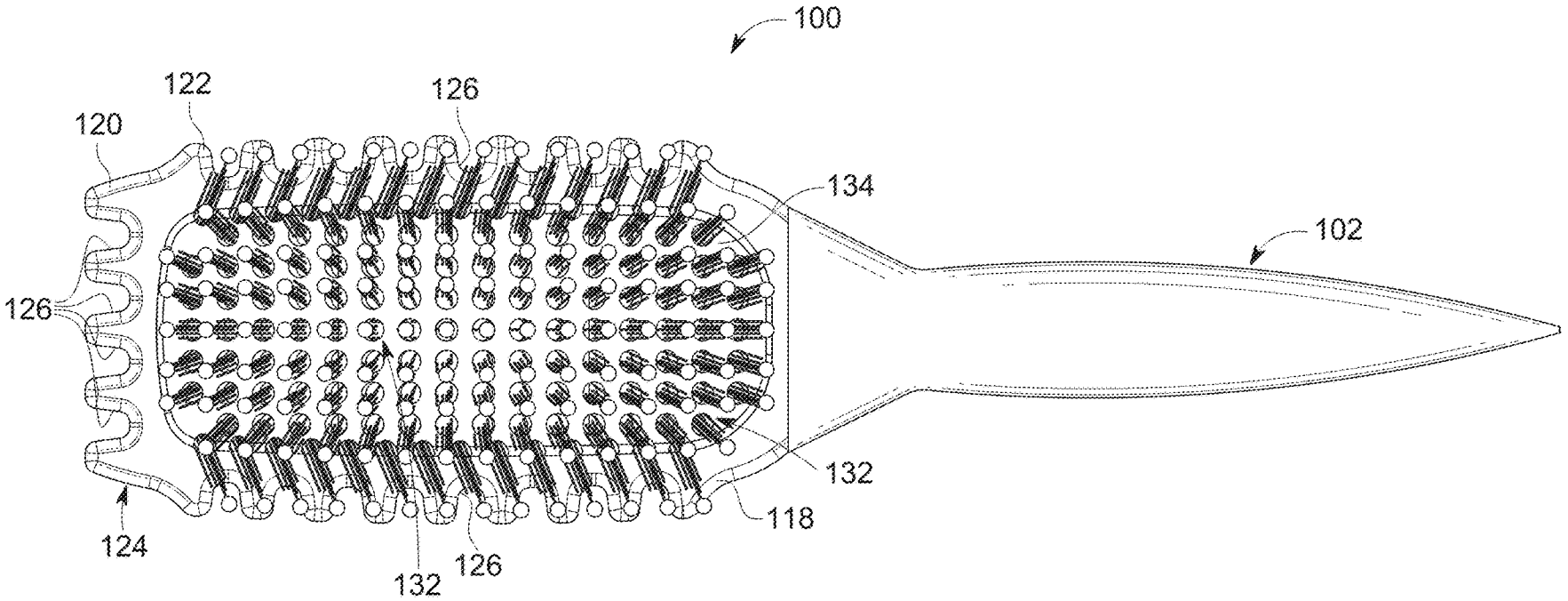
FIG. 2 is a top view of the hair brush of FIG. 1.
Figure 3:
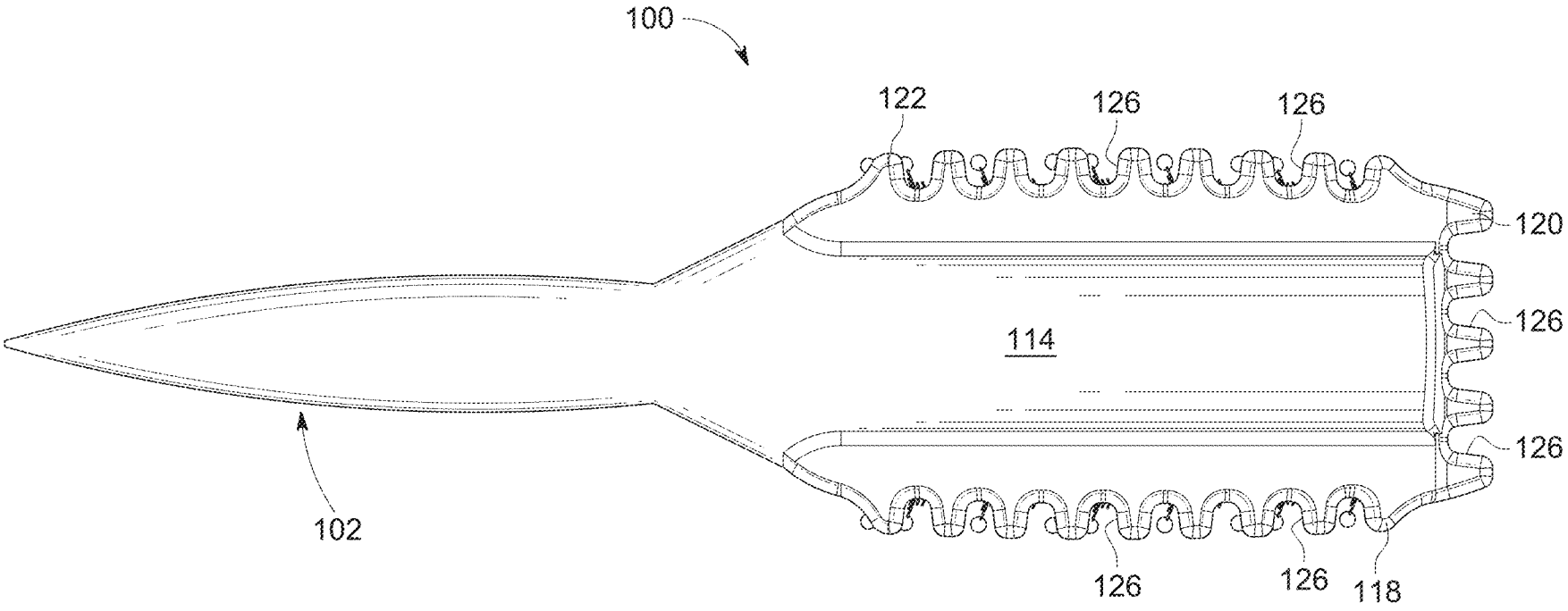
FIG. 3 is a bottom view of the hair brush of FIG. 1.
Figure 4:
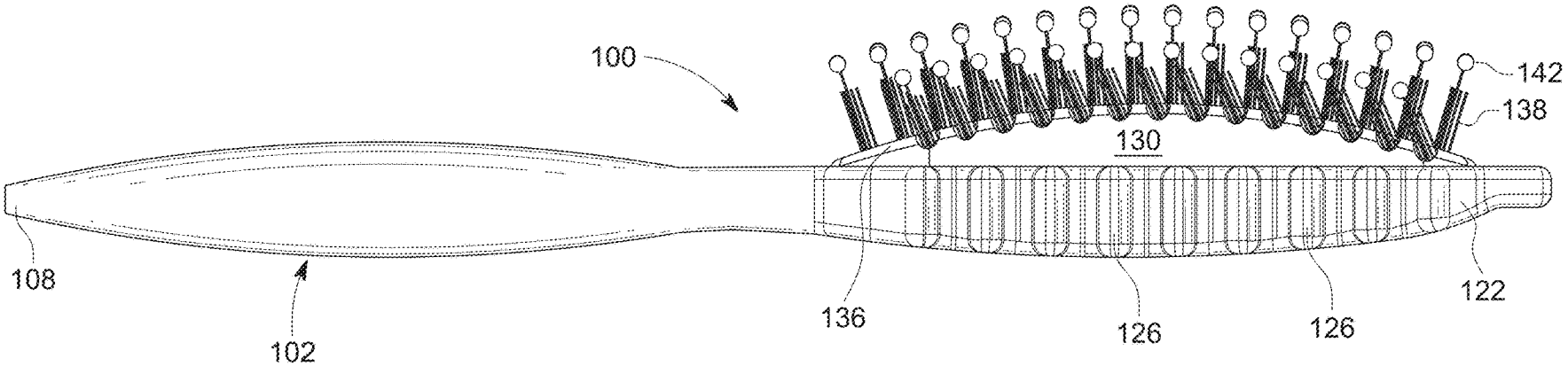
FIG. 4 is a right side view of the hair brush of FIG. 1.
Figure 5:
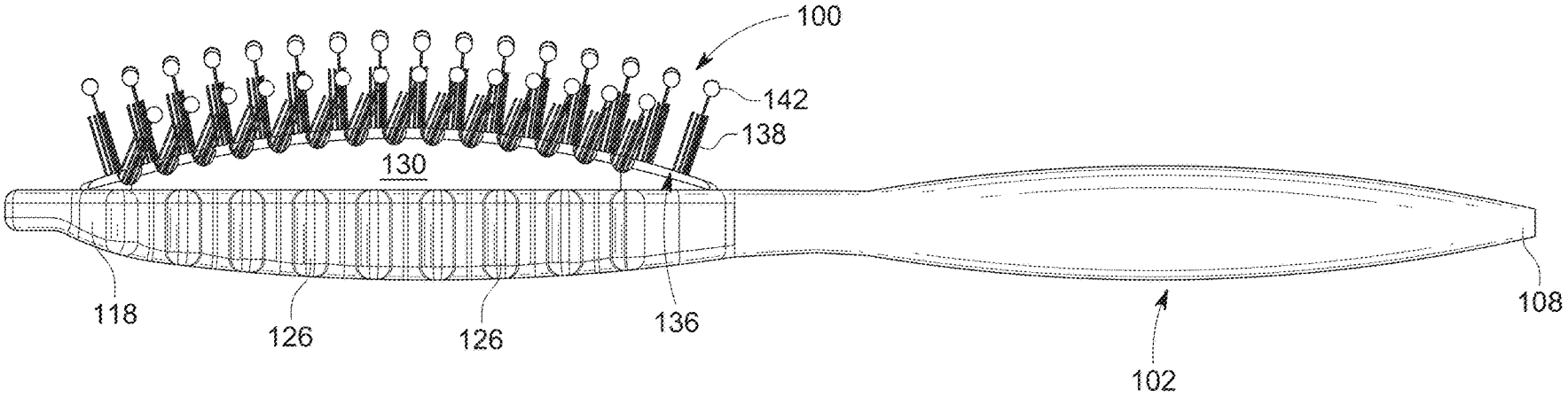
FIG. 5 is a left side view of the hair brush of FIG. 1.

Example implementations are now described with reference to the Figures. Reference numerals are used throughout the detailed description to refer to the various elements and structures. Although the following detailed description contains many specifics for the purposes of illustration, a person of ordinary skill in the art will appreciate that many variations and alterations to the following details are within the scope of the disclosed technology. Accordingly, the following implementations are set forth without any loss of generality to, and without imposing limitations upon, the claimed subject matter.

The examples discussed herein are examples only and are provided to assist in the explanation of the apparatuses, devices, systems, and methods described herein. None of the features or components shown in the drawings or discussed below should be taken as required for any specific implementation of any of these the apparatuses, devices, systems or methods unless specifically designated as such. For ease of reading and clarity, certain components, modules, or methods may be described solely in connection with a specific Figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

The present disclosure is described more fully hereinafter with reference to the accompanying drawings, in which exemplary embodiments of the present disclosure are shown. This present disclosure may, however, be embodied in many different forms and should not be construed as limited to the exemplary embodiments set forth herein. Rather, these embodiments are provided so that this disclosure will be thorough and complete, and will fully convey the scope of the present disclosure to those skilled in the art. In the drawings, the size and relative sizes of layers and regions may be exaggerated for clarity.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Similarly, the use of the word "or" is intended to be non-exclusive unless the context clearly indicates otherwise. It will be further understood that the terms "comprises" or "comprising," when used in this specification, specify the presence of stated features, integers, steps, operations, elements, or components, but do not preclude the presence or addition of one or more other features, integers, steps, operations, elements, components, or groups thereof.

Embodiments of the present disclosure are described herein with reference to illustrations that are schematic illustrations of idealized embodiments (and intermediate structures) of the present disclosure. As such, variations from the shapes of the illustrations as a result, for example, of manufacturing techniques or tolerances, are to be expected. Thus, embodiments of the present disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this present disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

With reference to FIGS. 1-6, hair brush 100 includes handle member 102 and head 110. Handle member 102 has body 104, neck 106, and tapered end 108. Head 110 includes top surface 112, bottom surface 114, and four sides 116, 118, 120, 122 that define perimeter 124 of head 110. A plurality of divided channels 126 are formed into sides 118, 120, 122 of head 110, having a predetermined depth extending between top surface 112 and bottom surface 114. In the present exemplary embodiment, the plurality of divided channels 126 are substantially U-shaped to partially expose each of divided channels 126 to environment 10. Side 116 of head 110 is fixed to neck 106 of handle member 102 to form monolithic, single-pieced hair brush 100.

Figure 6:
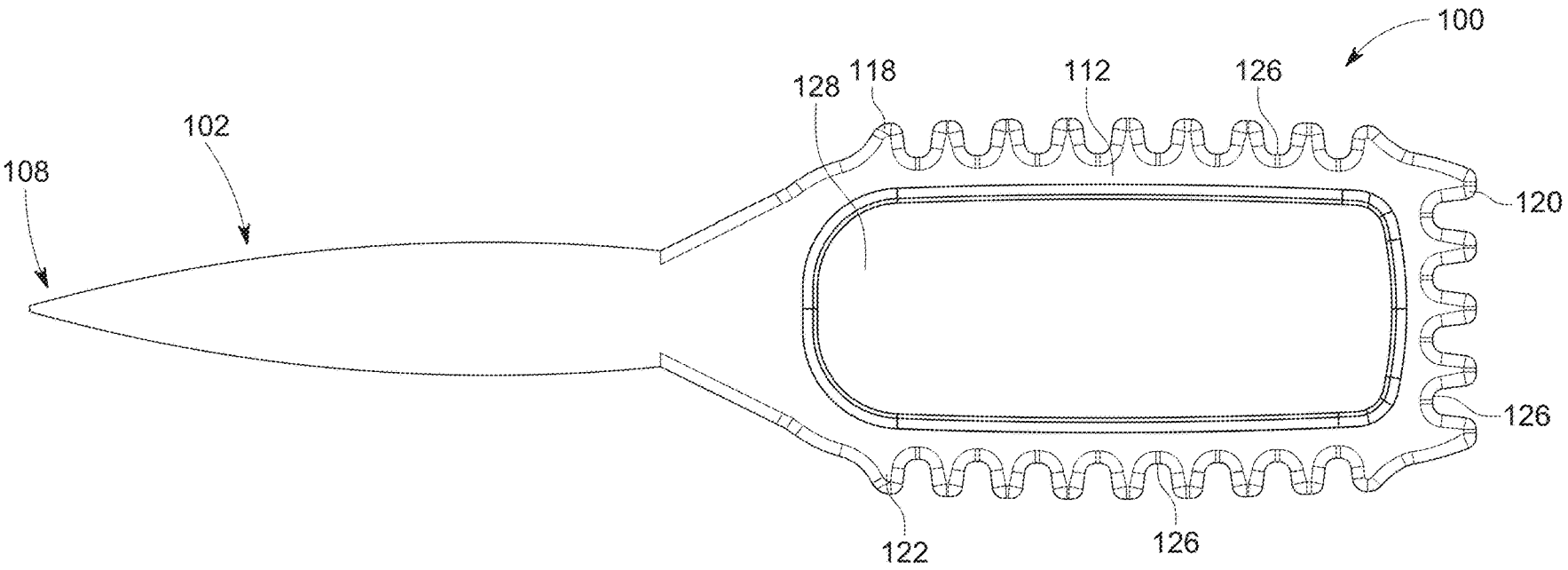
FIG. 6 is a top view of the hair brush of FIG. 1 showing a central cavity.

Still referring to the FIGS. 1-6, head 110 further includes central depression or cavity 128 formed in top surface 112 that receives bristle pad 130 (see FIG. 6). Bristle pad 130 has a plurality of holes 132 formed in face 134 and in edge 136. A plurality of bristles 138 with tips 142 protrude from holes 132 at a predetermined height and angle into environment 10. Holes 132 formed on face 134 are arranged in a plurality of rows 140. In the present exemplary embodiment, bristle pad 130 is elliptically shaped such that bristle pad 130 extends a predetermined height above top surface 112 of head 110. It is to be understood that bristle pad 130 can be any shape so as to sufficiently correspond to central cavity 128, including but not limited to spherical, rectangular, or square.

With reference to FIG. 6, a preferred embodiment of hair brush 100 has a length of about 240.97 millimeters (mm), and head 110 has a width of about 63.06 mm. In some embodiments, the length is in the range of 215-265 mm, such as 240 mm, and the width is in the range of 55-71 mm, such as 63 mm. Each of the plurality of divided channels 126 formed into sides 118 and 122 have a length of about 10.03 mm and are each separated by a length of about 5.14 mm. Each of the plurality of divided channels 126 formed into side 120 have a length of about 10.33 mm and are each separated by a length of about 5.09 mm. In some embodiments, each of the plurality of divided channels 126 formed into sides 118 and 122 have a length in the range of 9-11 mm, such as 10 mm, and are each separated by a length in the range of 4.5-5.5 mm, such as 5 mm. In some embodiments, each of the plurality of divided channels 126 formed into side 120 have a length in the range of 9-11 mm, such as 10 mm, and are each separated by a length in the range of 4.5-5.5 mm, such as 5 mm. The size of the plurality of divided channels and U-shape characteristic are such that each divided channel includes opposing sides positioned at between zero and 90 degrees with respect to each other. In the embodiment shown in connection with FIG. 6, each divided channel includes opposing sides positioned at an angle to one another in the range of 14-17.5 degrees. Furthermore, each of the plurality of divided channels 126 formed into sides 118 and 122 extend inwardly from the tips of the teeth about 6.16 mm, and each of the plurality of divided channels 126 formed into side 120 extend inwardly from the tips of the teeth about 7.14 mm. In some embodiments, each of the plurality of divided channels 126 formed into sides 118, 120 and 122 have a length in the range of 5.5-8.0 mm. In some cases, these channel depth and angular dimensions may be uniform across all product sides, or along a particular side with variation between any two sides. The particular dimensions and arrangements disclosed herein are provided to maximize the utility of a single brush with respect to hair types and style preferences, enhance waves, curls, and coils in hair, eliminate frizz, and promote hair smoothness.

Figure 7:
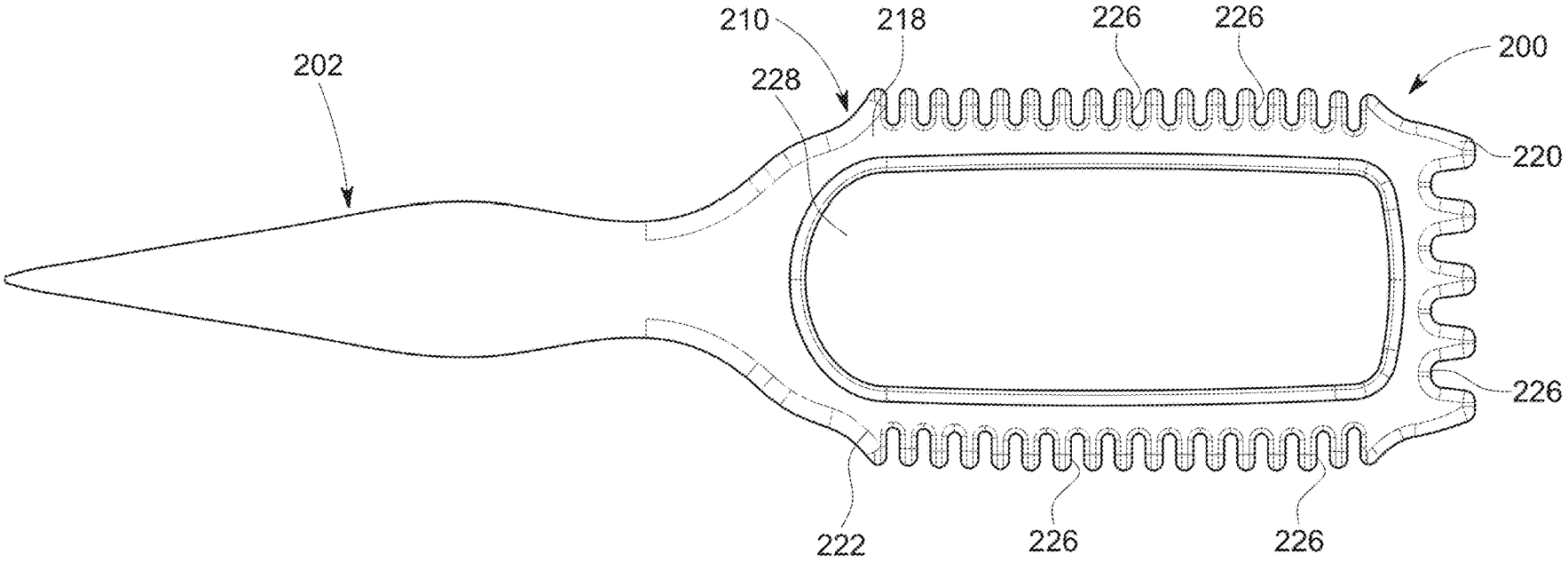
FIG. 7 is a top view of another example implementation of the disclosed hair brush showing a central cavity.

FIG. 7 provides a top view of a hair brush in accordance with a second exemplary implementation of the disclosed technology. In this implementation, hair brush 200 includes handle member 202 and head 210 having similar elements to that of handle member 102 and head 110 of hair brush 100, the difference being that a greater number of divided channels 226 are formed into sides 218 and 222 than that of divided channels 126 formed into sides 118 and 122. While not explicitly shown in FIG. 9, it is to be understood that a bristle pad similar to that of bristle pad 130 can be placed within central cavity 228 of head 210.

Still referring to FIG. 7, hair brush 200 has a length of about 240.97 millimeters (mm), and head 210 has a width of about 63.06 mm. In some embodiments, the hair brush 200 has a length in the range of 215-265 mm, such as 240 mm, and head 210 has a width in the range of 55-71 mm, such as 63 mm. Each of the plurality of divided channels 226 formed into sides 218 and 222 have a length of about 5.01 mm and are each separated by a length of about 2.51 mm. Each of the plurality of divided channels 226 formed into side 220 have a length of about 10.33 mm and are each separated by a length of about 5.09 mm. In some embodiments, each of the plurality of divided channels 226 formed into sides 218 and 222 have a length in the range of 4.5-5.5 mm, such as 5 mm, and are each separated by a length in the range of 2.25-2.75 mm, such as 2.5 mm. In some embodiments, each of the plurality of divided channels 226 formed into side 220 have a length in the range of 9-11 mm, such as 10 mm, and are each separated by a length in the range of 4.5-5.5 mm, such as 5 mm. In the embodiment shown in connection with FIG. 7, each divided channel includes opposing sides positioned at an angle to one another in the range of 14-17.5 degrees with respect to the end plurality of divided channels, and 3.5-4.5 degrees with respect to the lateral plurality of divided channels. In some cases, the channel angular dimension is in the range of zero to 25 degrees. Furthermore, each of the plurality of divided channels 226 formed into sides 218 and 222 extend inwardly from the tips of the teeth about 5.90 mm, and each of the plurality of divided channels 226 formed into side 220 extend inwardly from the tips of the teeth about 7.14 mm. In some embodiments, each of the plurality of divided channels 226 formed into sides 218, 220 and 222 have a length in the range of 5.0-8.0 mm. In some cases, these channel depth and angular dimensions may be uniform across all product sides, or along a particular side with variation between any two sides. The particular dimensions and arrangements disclosed herein are provided to maximize the utility of a single brush with respect to hair types and style preferences, enhance waves, curls, and coils in hair, eliminate frizz, and promote hair smoothness.

Figure 8:
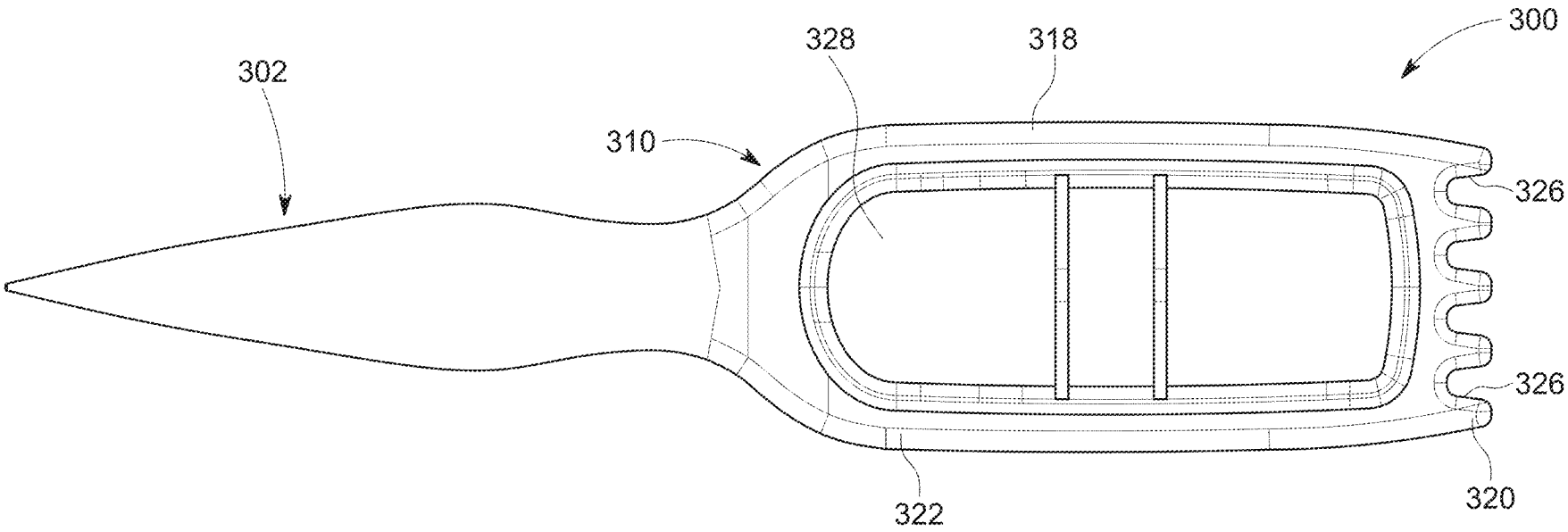
FIG. 8 is a top view of yet another example implementation of the disclosed hair brush showing a central cavity.

FIG. 8 provides a top view of a hair brush in accordance with a third exemplary implementation of the disclosed technology. In this implementation, hair brush 300 includes handle member 302 and head 310 having similar elements to that of handle member 102 and head 110 of hair brush 100, the difference being that only side 320 of head 310 includes a plurality of divided channels 326. While not explicitly shown in FIG. 10, it is to be understood that a bristle pad similar to that of bristle pad 130 can be placed within central cavity 328 of head 310.

Still referring to FIG. 8, hair brush 300 has a length of about 241.00 mm, and head 310 has a width of about 53.39 mm. Each of the plurality of divided channels 326 formed into side 320 has a length of about 10.33 mm and are each separated by a length of about 5.09 mm. In some embodiments, hair brush 300 has a length in the range of 215-265 mm, such as 240 mm, head 310 has a width in the range of 47-59 mm, such as 53 mm, and each of the plurality of divided channels 326 formed into side 320 has a length in the range of 9-11 mm, such as 10 mm and are each separated by a length in the range of 4.5-5.5 mm, such as 5 mm. In the embodiment shown in connection with FIG. 8, each divided channel includes opposing sides also positioned at an angle to one another in the range of 14-17.5 degrees.

The disclosed hair brushes allows users to enhance waves, curls, and coils of their hair, while also allowing for smoothing, creating well-defined clumps, and preventing frizz. The plurality of bristles allow for hair brushing, while the plurality of divided channels separate and smooth the hair. Further, users can wrap their hair around the handle member of the disclosed hair brushes to form elegant ringlets. The tapered end of the handle member can doubles as a tool for creating perfectly straight, parted lines in a user's hair.

The head of the disclosed hair brushes is substantially rectangular; however, it is to be understood that the head may be circular, square, triangular, oval, or the like. The head and handle member of the disclosed hair brushes can be formed from an eco-friendly, bio-based composition. Such head and handle member may include materials that are non-plastic and biodegradable. The bristles used with the disclosed hair brushes may be vegan boar bristles.

Various sizes and geometries of the plurality of divided channels are possible. Any of the plurality of divided channels of the disclosed hair brushes can be sized and separated in accordance with any of the disclosed dimensions and lengths described herein.

Having shown and described a preferred embodiment of the present disclosure, those skilled in the art will realize that many variations and modifications may be made to affect the described present disclosure and still be within the scope of the present disclosure. Additionally, many of the elements indicated above may be altered or replaced by different elements which will provide the same result and fall within the spirit of the present disclosure. It is the intention, therefore, to limit the invention only as indicated by the scope of the claim.

All literature and similar material cited in this application, including, but not limited to, patents, patent applications, articles, books, treatises, and web pages, regardless of the format of such literature and similar materials, are expressly incorporated by reference in their entirety. Should one or more of the incorporated references and similar materials differs from or contradicts this application, including but not limited to defined terms, term usage, described techniques, or the like, this application controls.

As previously stated and as used herein, the singular forms "a", "an", and "the" refer to both the singular as well as plural, unless the context clearly indicates otherwise. The term "comprising" as used herein is synonymous with "including", "containing" or "characterized by" and is inclusive or open-ended and does not exclude additional, unrecited elements or method steps. Although many methods and materials similar or equivalent to those described herein can be used, particular suitable methods and materials are described herein. Unless context indicates otherwise, the recitations of numerical ranges by endpoints include all numbers subsumed within that range. Furthermore, references to "one implementation" are not intended to be interpreted as excluding the existence of additional implementations that also incorporate the recited features. Moreover, unless explicitly stated to the contrary, implementations "comprising" or "having" an element or a plurality of elements having a particular property may include additional elements whether or not they have that property.

The terms "substantially" and "about" describe and account for small fluctuations, such as due to variations in processing or operational ranges that are evident from the disclosure to those skilled in the art, for instance. For example, these terms can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%, or 0%.

Underlined or italicized headings and subheadings are used for convenience only, do not limit the disclosed subject matter, and are not referred to in connection with the interpretation of the description of the disclosed subject matter. All structural and functional equivalents to the elements of the various implementations described throughout this disclosure that are known or later come to be known to those of ordinary skill in the art are expressly incorporated herein by reference and intended to be encompassed by the disclosed subject matter. Moreover, nothing disclosed herein is intended to be dedicated to the public regardless of whether such disclosure is explicitly recited in the above description.

There may be many alternate ways to implement the disclosed technology. Various functions and elements described herein may be partitioned differently from those shown without departing from the scope of the disclosed technology. Generic principles defined herein may be applied to other implementations. Different numbers of a given module or unit may be employed, a different type or types of a given module or unit may be employed, a given module or unit may be added, or a given module or unit may be omitted.

Regarding this disclosure, the term "a plurality of" refers to two or more than two. Unless otherwise clearly defined, orientation or positional relations indicated by terms such as "upper" and "lower" are based on the orientation or positional relations as shown in the Figures, only for facilitating description of the disclosed technology and simplifying the description, rather than indicating or implying that the referred devices or elements must be in a particular orientation or constructed or operated in the particular orientation, and therefore they should not be construed as limiting the disclosed technology. The terms "connected", "mounted", "fixed", etc. should be understood in a broad sense. For example, "connected" may be a fixed connection, a detachable connection, or an integral connection, a direct connection, or an indirect connection through an intermediate medium. For an ordinary skilled in the art, the specific meaning of the above terms in the disclosed technology may be understood according to specific circumstances.

It should be appreciated that all combinations of the foregoing concepts and additional concepts discussed in greater detail herein (provided such concepts are not mutually inconsistent) are contemplated as being part of the disclosed technology. In particular, all combinations of claimed subject matter appearing at the end of this disclosure are contemplated as being part of the technology disclosed herein. While the disclosed technology has been illustrated by the description of example implementations, and while the example implementations have been described in certain detail, there is no intention to restrict or in any way limit the scope of the appended claims to such detail. Additional advantages and modifications will readily appear to those skilled in the art. Therefore, the disclosed technology in its broader aspects is not limited to any of the specific details, representative devices and methods, and/or illustrative examples shown and described. Accordingly, departures may be made from such details without departing from the spirit or scope of the general inventive concept.

What is claimed:

1. A brush, comprising:

a first plurality of channels disposed along a first side of a brush head;

a second plurality of channels disposed along a second side of the brush head;

a third plurality of channels disposed along a third side of the brush head; and a brush pad having a plurality of bristles, wherein each of the first, second, and third plurality of channels has a predetermined depth that extends from a top surface of the brush head to a bottom surface of the brush head, wherein each of the first plurality of channels:

has a length of about 10.03 mm and is separated by a distance of about 5.14 mm;

has a length of about 10.33 mm and is separated by a distance of about 5.09 mm; or has a length of about 5.01 mm and is separated by a distance of about 2.51 mm;

wherein each of the second plurality of channels:

has a length of about 10.03 mm and is separated by a distance of about 5.14 mm;

has a length of about 10.33 mm and is separated by a distance of about 5.09 mm; or has a length of about 5.01 mm and is separated by a distance of about 2.51 mm; and wherein each of the third plurality of channels:

has a length of about 10.03 mm and is separated by a distance of about 5.14 mm;

has a length of about 10.33 mm and is separated by a distance of about 5.09 mm; or has a length of about 5.01 mm and is separated by a distance of about 2.51 mm.

2. The hair brush of claim 1, wherein the first, second, and third plurality of channels are substantially U-shaped.

3. The brush of claim 1, further comprising a handle member connected to the brush head, wherein the handle member includes a tapered end.

* * * * *